US007073256B2

(12) United States Patent
Muranaka et al.

(10) Patent No.: US 7,073,256 B2
(45) Date of Patent: Jul. 11, 2006

(54) METHOD OF MANUFACTURING CENTER ELECTRODE FOR SPARK PLUG

(75) Inventors: Hirofumi Muranaka, Suzuka (JP); Kazuhiko Tanaka, Kuwana (JP); Akihiro Endou, Mie-ken (JP)

(73) Assignee: Denso Corporation (JP)

( * ) Notice: Subject to any disclaimer, the term of this patent is extended or adjusted under 35 U.S.C. 154(b) by 283 days.

(21) Appl. No.: 10/688,984

(22) Filed: Oct. 21, 2003

(65) Prior Publication Data

US 2004/0078971 A1 Apr. 29, 2004

(30) Foreign Application Priority Data

Oct. 25, 2002 (JP) ..... 2002-310815

(51) Int. Cl.
*H01R 43/04* (2006.01)
*H01T 21/02* (2006.01)

(52) U.S. Cl. ..... 29/882; 29/508; 29/511; 29/517; 29/746; 445/7

(58) Field of Classification Search ..... 29/432, 29/505, 508, 511, 517, 525, 746, 761, 854, 29/874, 876, 592.1, 882, 610.1; 445/7, 50; 313/11.5; 72/356; 123/169 EL
See application file for complete search history.

(56) References Cited

U.S. PATENT DOCUMENTS 3,548,472 A * 12/1970 Hiroshi et al. ..... 445/7
3,857,145 A * 12/1974 Yamaguchi et al. ..... 445/7
4,526,551 A * 7/1985 Hoffmanner et al. ..... 445/7
4,575,343 A * 3/1986 Kin et al. ..... 445/7
4,606,730 A * 8/1986 Kin et al. ..... 445/7
4,684,352 A * 8/1987 Clark et al. ..... 445/7
4,695,759 A * 9/1987 Podiak ..... 313/136
4,803,395 A * 2/1989 Matesco ..... 313/141
4,904,216 A * 2/1990 Kagawa et al. ..... 445/7
5,743,777 A * 4/1998 Demeuter ..... 445/7

FOREIGN PATENT DOCUMENTS

| | | | |
|---|---|---|---|
| GB | 2069378 A | * | 8/1981 |
| JP | 5-144545 | | 6/1993 |
| JP | 9-120882 | | 5/1997 |
| JP | 10-22054 | | 1/1998 |

* cited by examiner

*Primary Examiner*—Peter Vo
*Assistant Examiner*—Livius Radu Cazan
(74) *Attorney, Agent, or Firm*—Nixon & Vanderhye PC

(57) ABSTRACT

In a method of manufacturing a center electrode for a spark plug, a core member is press-fitted into a metal cup and, thereafter, a cold-forging process is performed to form a small-diameter portion at a closed end of the metal cup. The small-diameter portion is completely free from deformation which may occur during press-fitting operation. Thus, the small-diameter portion has excellent accuracy in shape. Furthermore, since the press-fitting is performed before the cold-forging of the small-diameter portion, it is possible to increase the press-fitting load or pressure to the extent that the core member and the metal cup are joined together with a sufficient degree of adhesion which will insure the a center electrode to have good thermal conductivity.

16 Claims, 4 Drawing Sheets

METHOD OF MANUFACTURING CENTER ELECTRODE FOR SPARK PLUG

BACKGROUND OF THE INVENTION

1. Field of the Invention

The present invention relates to a method of manufacturing a center electrode for a spark plug adapted to be assembled in an internal combustion engine.

2. Description of the Related Art

Conventionally, a center electrode for spark plugs includes a metal cup formed into a bottomed hollow cylinder and a core member inserted into the metal cup. The core member is made of metal having a higher thermal conductivity than the cup. The center electrode has a fore end formed with a small-diameter portion. The small-diameter portion is formed by a cutting or turning process.

Formation of the small-diameter portion by cutting operation, however, requires a relatively long machining time and hence the machining cost increases correspondingly. One prior approach taken to obviate the need for cutting operation is known as disclosed in, for example, Japanese Patent Laid-open Publication (JP-A) No. 09-120882. According to the disclosed approach, a metal cup is forged to form a small-diameter portion and, thereafter, a core member is press-fitted in the metal cup. A problem is that the small-diameter portion forms a bearing surface which receives a press-fitting load or pressure during press-fitting operation. The small-diameter portion is, therefore, likely to deform. An attempt to lower the press-fitting load to thereby suppress deformation of the small-diameter portion has been made, but the result is not fully satisfactory in that due to insufficient adhesion between a bottom portion of the metal cup and a fore end portion of the core member, thermal conductivity of the center electrode is deteriorated.

With the foregoing difficulties in view, an object of the present invention is to provide a method which is capable of manufacturing a center electrode at a relatively low machining cost, with excellent accuracy in shape of a small-diameter portion, and with good adhesion between a metal cup and a core member,

SUMMARY OF THE INVENTION

To achieve the foregoing object, according to the present invention, there is provided a method of manufacturing a center electrode for a spark plug, comprising the steps of press-fitting a core member into a metal cup, the metal cup being formed in a hollow cylinder with one end closed, the core member being made of metal having a higher thermal conductivity than the metal cup; and, thereafter, performing a cold-forging process to form a small-diameter portion at the closed end of the metal cup.

According to the method of the present invention, the small-diameter portion is formed without using a cutting process. This achieves a considerable reduction in machining cost. Furthermore, since the small-diameter portion is formed after the core member is press-fitted in the metal cup, it does never occur that the small-diameter portion is deformed during press-fitting operation. Additionally, because the press-fitting operation is performed before the small-diameter portion is formed, it is possible to increase the press-fitting load or pressure to the extent that the cup and the core member are joined or united together with a sufficient degree of adhesion. A center electrode having excellent thermal conductivity can thus be produced.

The core member may be made of copper. Preferably, the core member is formed by cutting a continuous copper wire into individual copper pieces before the press-fitting process. The metal cup may be made of nickel-base alloy.

It is preferable that before the press-fitting step, the method further comprises the step of removing a rough edge or burr from the core member. With this de-burring process, the core member can be smoothly press-fitted in the metal cup. The de-burring step is preferably carried out by an upsetting process in which opposite end faces of the core member are punched or hammered.

Preferably, the press-fitting step is carried out without using oil. If oil is used during press-fitting operation, it may occur that oil is caught or left between the core member and the metal cup and eventually varies the thermal value of a spark plug in which the center electrode is used. According to the method of the present invention, the core member and the metal cup are joined together without oil caught or left therebetween. Accordingly, variation in thermal value of the spark plug is very small.

BRIEF DESCRIPTION OF THE DRAWINGS

A preferred structural embodiment of the present invention will be described in detail herein below, by way of example only, with the reference to the accompanying drawings, in which.

DETAILED DESCRIPTION OF THE PREFERRED EMBODIMENT

Figure 1:
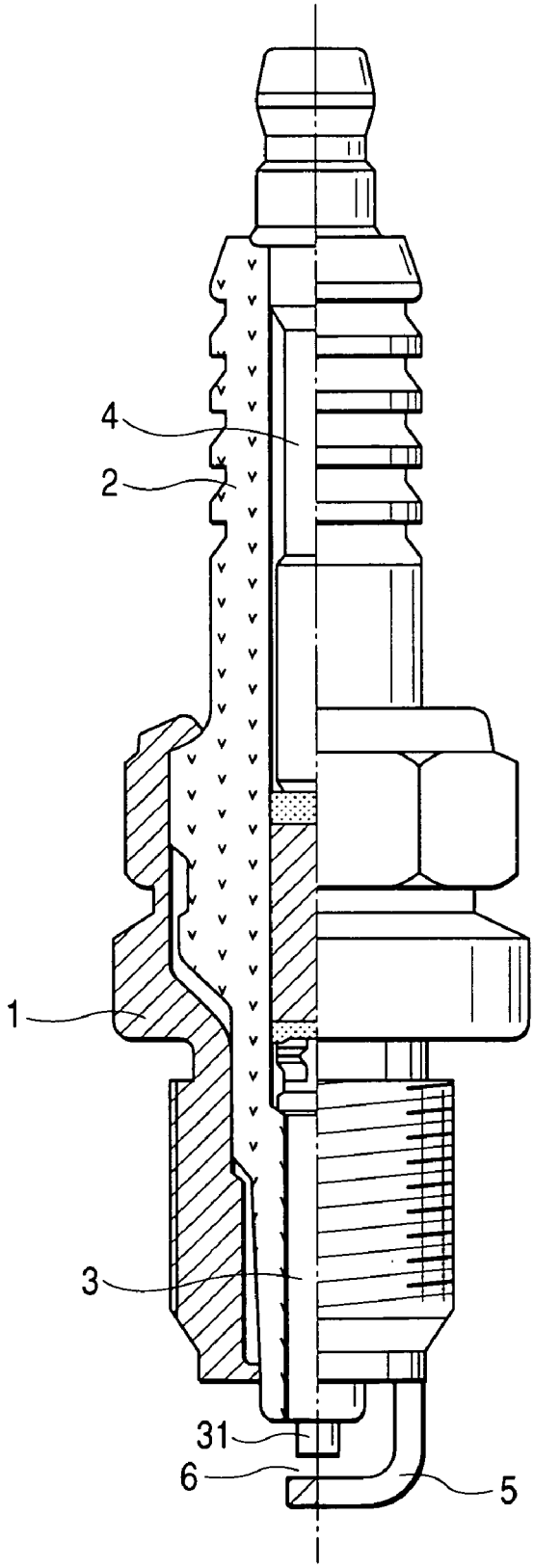
FIG. 1 is a schematic front view, half in cross section, of a spark plug having a center electrode manufactured in accordance with a method of the present invention.

Referring now to the drawings and FIG. 1 in particular, there is shown a spark plug having a center electrode made in accordance with a method of the present invention. The spark plug includes a hollow cylindrical housing 1 made of electrically conductive steel such as low carbon steel, a hollow cylindrical insulator 2 made of aluminum ceramics such as $Al_2O_3$ and held in an axial hole of the housing 1, and a solid cylindrical center electrode 3 and a solid cylindrical stem 4 that are held coaxially in an axial hole of the insulator 2. A ground electrode 5 is joined by welding to an end (lower end in FIG. 1) of the cylindrical housing 1. The ground electrode 5 is bent into an L-shape so that it partially lies opposite a fore end 31 of the center electrode 3 with a discharge gap 6 defined therebetween.

The center electrode 3 includes a metal cup formed into a bottomed hollow cylinder (i.e., a hollow cylinder having one end closed), and a solid cylindrical core member made of metal having a higher thermal conductivity than the metal cup. In the illustrated embodiment, the metal cup is made of nickel-base alloy such as inconel, and the core member is made of copper.

Description will be made next to a method of manufacturing the center electrode 3 with reference to FIGS. 2A–2H and 3A–3B.

Figure 2A:
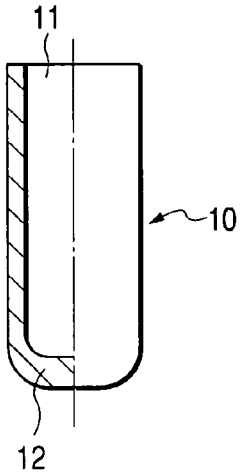
FIGS. 2A through 2H are schematic front views, half in cross section, showing a sequence of processing operations achieved to manufacture the center electrode according to the present invention.
Figure 2B:
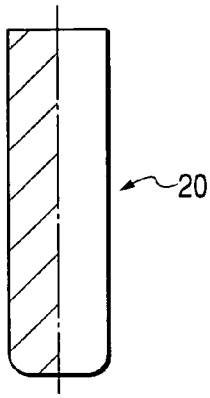

At first, a continuous wire of nickel-base alloy is cut into blank metal pieces each of which is then subjected to a cold-forging process to produce a bottomed cylindrical cup 10 (i.e., a cylindrical cup having one end 12 closed), such as shown in FIG. 2A. Separately, a continuous copper wire is cut to produce a solid cylindrical core member 20, such as shown in FIG. 2B. Preferably, the cutting process is followed by an upsetting process in which opposite cut end faces of the cylindrical core member 20 are punched or hammered to remove a rough edge or burr which may be left on the cut end faces. Thus, the core member 20 is free from burr.

Figure 2C:
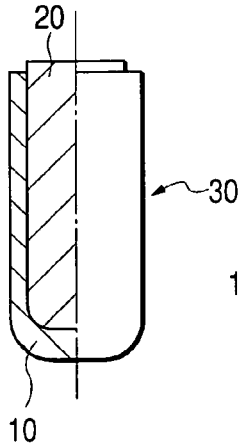

Then, the core member 20 is press-fitted in an axial hole 11 of the cylindrical cup 10 to thereby produce a cup-and-core assembly 30 in which the cup 10 and the core member 20 are tightly joined or united together, as shown in FIG. 2C. In order to achieve a sufficient degree of adhesion between the cup 10 and the core member 20, a press-fitting load or pressure is preferably set at 3 to 5 kN.

All of the foregoing processes (i.e., the cutting and cold-forging processes to produce the metal cup 10, the cutting and upsetting processes to produce the core member 20, and the press-fitting process to produce the cup-and-core assembly 30) are carried out without using oil, such as cold-forging oil. In subsequent processes, however, oil may be used when needed.

Figure 2D:
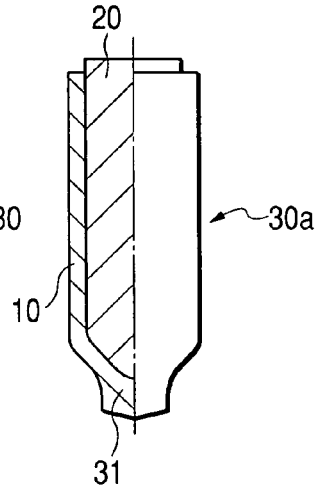

The cup-and-core assembly 30 is then processed to form a small-diameter portion 31, as shown in FIG. 2D. The small-diameter portion 31 is formed by a cold-forging apparatus shown in FIG. 3A. More specifically, the cold-forging apparatus includes a lower die D1 having a vertical small-diameter hole D11 and an upper punch P1 for forcing or driving the cup-and-core assembly 30 into the hole D11. The die D1 and the punch P1 are used in combination to perform an extrusion process for producing a small-diameter portion 31 at a fore end of the bottom or closed end 12 (FIG. 2A) of the cup 10. In FIG. 2D, a cup-and-core assembly having such small-diameter portion 31 is designated by 30*a*.

Subsequently, a second extrusion process is effected on the cup-and-core assembly 30*a* to produce a cup-and-core assembly 30*b* shown in FIG. 2E. The cup-and-core assembly 30*b* has an elongated large-diameter portion 32 contiguous to an upper end of the small-diameter portion 31, and a head portion 33 contiguous to an upper end of the large-diameter portion 32. The head portion 33 is left un-extruded and hence has the same outside diameter as the cup-and-core assembly 30*a* of the preceding processing step shown in FIG. 2D. The head portion 33 is then removed by cutting with the result that a cup-and-core assembly 30*c* shown in FIG. 2F is produced.

Figure 2E:
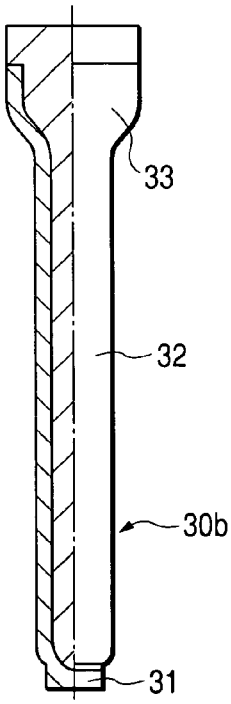
Figure 2F:
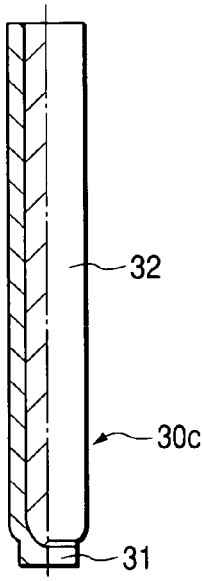
Figure 2G:
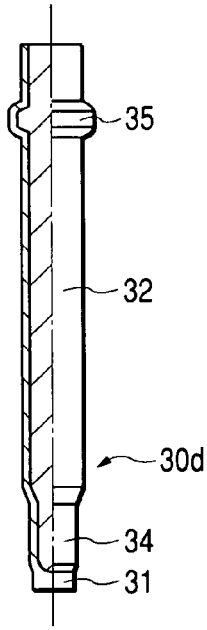

The large-diameter portion 32 of the cup-and-core assembly 30*c* is processed to form a cup-and-core assembly 30*d* having an intermediate-diameter portion 34 and a flange portion 35, as shown in FIG. 2G. More specifically, by using a die D2 and a punch P2 shown in FIG. 3B, the cup-and-core assembly 30*c* of FIG. 2F is cold-forged into the cup-and-core assembly 30*d* of FIG. 2G. In this instance, the large diameter portion 32 is processed such that the intermediate-diameter portion 34 is formed at a portion located adjacent to the small-diameter potion 31, and the flange portion 35 is formed at a portion near an end (upper end in FIGS. 2G and 3B) remote from the small-diameter portion 31.

Figure 2H:
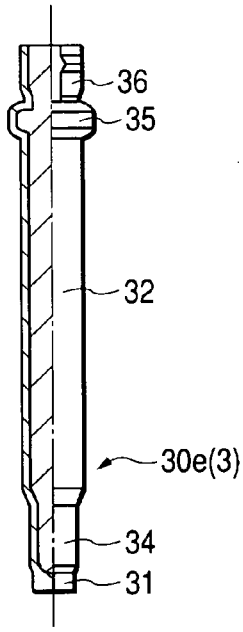
Figure 3A:
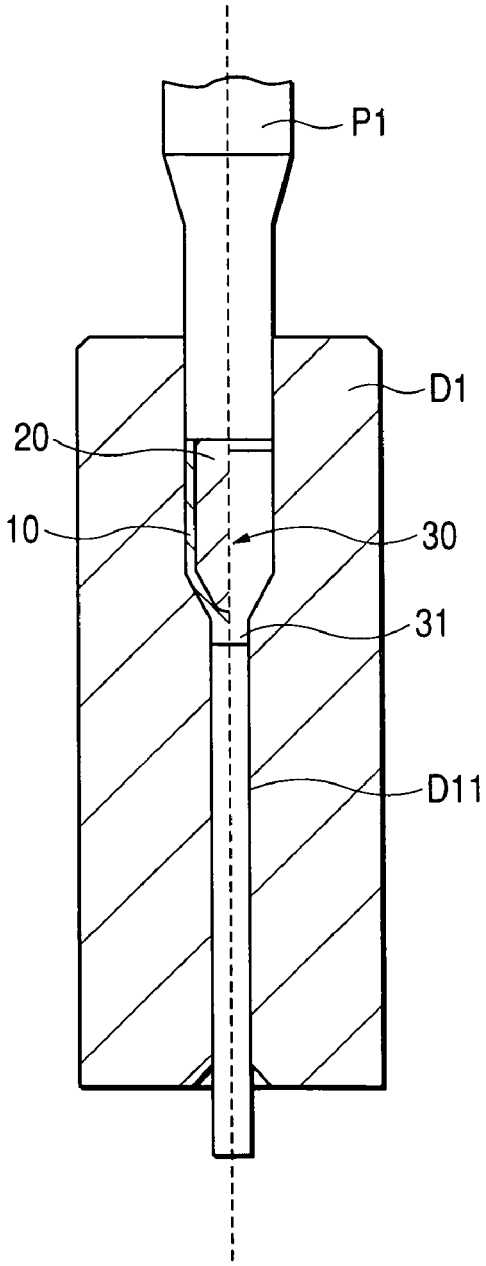
FIGS. 3A and 3B are cross-sectional views showing part of a forging apparatus used to carry out the operations shown in FIGS. 2A–2H.
Figure 3B:
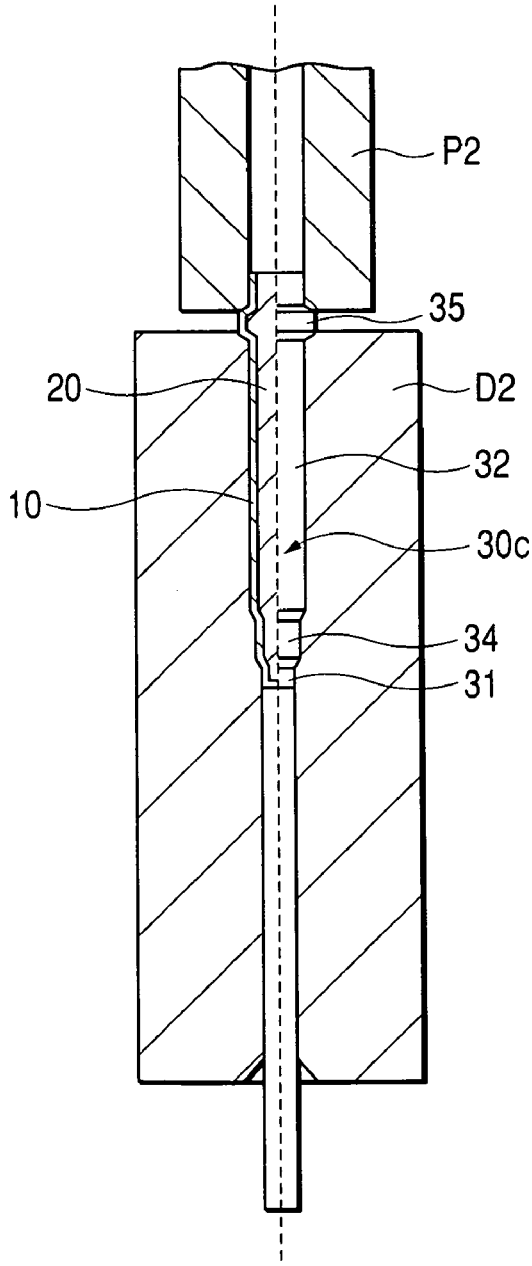

Then, the upper end portion of the large-diameter portion 32, which extends upward from the flange portion 35, is processed to form three circumferentially spaced radial wings 36, as shown in FIG. 2H. A cup-and-core assembly 30*e* having such radial wings 36 is subsequently subjected to a welding process in which a tip of precious metal (not shown) is attached by welding to an apical surface of the small-diameter portion 31. The prescribed sequence of processing operations has thus completed and a center electrode 3 is produced.

As thus far explained, the small-diameter portion 31 is formed without using cutting operation, so that the machining cost is reduced.

Furthermore, the core member 20 is press-fitted in the metal cup 10 before a small-diameter portion 31 is formed on the metal cup 10. Accordingly, the small-diameter portion 31 is completely free from deformation which may otherwise occur during press-fitting operation. This ensures that a center electrode is manufactured with excellent accuracy in shape of the small-diameter portion 31.

Additionally, since the small-diameter portion 31 is formed after the core member 20 is press-fitted in the metal cup 10, it is possible to increase the press-fitting load or pressure to the extent that the metal cup 10 and the core member 20 are joined or united together with sufficient adhesion which will insure production of a center electrode 3 with excellent thermal conductivity.

Furthermore, by virtue of the de-burring process achieved before the press-fitting operation, the core member 20 can be smoothly press-fitted in the metal cup 10.

Figure 4:
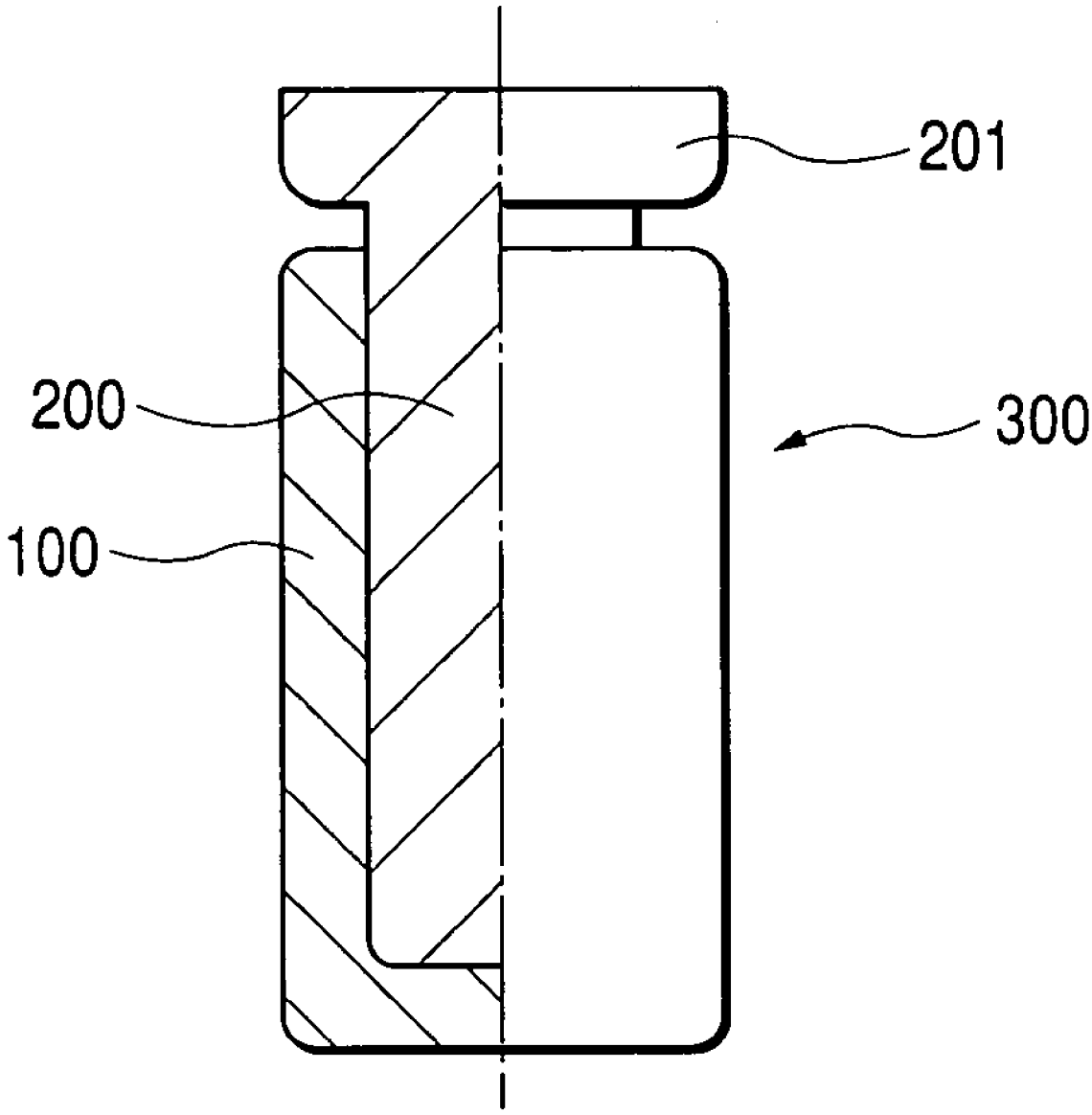
FIG. 4 (PRIOR ART)
FIG. 4 is a front view, half in cross section, showing a conventional cup-and-core assembly.

As shown in FIG. 4, a conventional cup-and-core assembly 300 has a core member 200 having an enlarged head or flange 201. The flange 201 is formed before the core member 200 is press-fitted in a metal cup 100. The flange-forming process involves the use of oil. Accordingly, it may occur that the oil is caught between the core member 200 and the metal cup 100 during press-fitting operation and eventually varies the thermal value of a spark plug in which a center electrode formed from the cup-and-core assembly 300 is incorporated.

On the other hand, according to the present invention, the core member 20 is in the form of a solid cylinder free from an enlarged head or a flange and having a uniform outside diameter substantially throughout the length thereof. Furthermore, before the core member 20 is press-fitted in the metal cup 10, all of the processing operations are carried out without using oil. The oil may be used when a small-diameter portion 31 is formed on a cup-and-core assembly 30 produced as a result of press-fitting operation between the core member 20 and the metal cup 10, as shown in FIGS. 2C and 2D.

As discussed above, the method of the present invention does not use oil before the core member 20 is press-fitted in the metal cup 10. Accordingly, it does never occur that the oil is caught between the core member 20 and the metal cup 10 during press-fitting operation. This means that variation in thermal value of the spark plug is very small.

It is preferable to automate both operation of processing machines or apparatuses in the respective stations and transfer of works (i.e., metal cup 10, core member 20 and cup-and-core assembly 30) to a subsequent station so that the foregoing processing operations can be achieved continuously and automatically.

Furthermore, in order to improve the dimensional accuracy of the small-diameter portion 31, a two-stage forming process may be employed in which at a first stage of forming, such as shown in FIG. 2D, a small-diameter portion 31 is roughly formed and, at a second stage of forming, such as shown in FIG. 2E, the small-diameter portion 31 is finished with higher accuracy at the same time the large-diameter portion 32 is formed.

Obviously, various minor changes and modifications are possible in the light of the above teaching. It is to be understood that within the scope of the appended claims the present invention may be practiced otherwise than as specifically described.

What is claimed is:

1. A method of manufacturing a center electrode for a spark plug, comprising the steps of:

press-fitting a core member into a metal cup, the metal cup being formed as a hollow cylinder with one end closed, the core member being made of metal having a higher thermal conductivity than the metal cup and being in the form of a solid cylinder free from an enlarged head or a flange and having a uniform outside diameter substantially throughout the length thereof; and thereafter, performing a cold-forging process to form a small-diameter portion protruding axially from the closed end of the metal cup, wherein the small-diameter portion is smaller in diameter than a transverse cross-section through the cup and core member assembly from which it protrudes, thereby forming the center electrode.

2. The method according to claim 1, wherein the core member is made of copper.

3. The method according to claim 2, before the press-fatting step, further comprising the step of cutting a continuous copper wire into individual copper pieces each forming the core member.

4. The method according to claim 3, after the cutting step and before the press-fitting step, further comprising the step of removing a rough edge or burr from opposite cut end faces of the core member.

5. The method according to claim 4, wherein the removing step is carried out by an upsetting process in which the opposite cut end faces of the core member are punched or hammered.

6. The method according to claim 4, wherein the removing step is carried out without using oil.

7. The method according to claim 3, wherein the cutting step is carried out without using oil.

8. The method according to claim 1, wherein the metal cup is made of nickel-base alloy.

9. The method according to claim 1, before the press-fitting step, further comprising the step of removing a rough edge or burr from the core member.

10. The method according to claim 9, wherein the removing step is carried out by an upsetting process in which opposite end faces of the core member are punched or hammered.

11. The method according to claim 9, wherein the removing step is carried out without using oil.

12. The method according to claim 1, wherein the press-fitting step is carried out without using oil.

13. The method according to claim 1, further comprising, after forming said small-diameter portion, setting the cup and core assembly into a die having a large-diameter portion, an intermediate-diameter portion and a small-diameter portion; and cold-forging the cup and core assembly in said die to cause said cup and core assembly to comprise a large-diameter portion, an intermediate-diameter portion and a small-diameter portion corresponding to said portions of said die.

14. The method according to claim 1, when said performing a cold-forging process comprises setting the assembly of the metal cup and the core member pressed-fitted thereinto into a first die having a small-diameter portion corresponding to the small-diameter portion to be formed at the closed end of the metal cup, and causing the cup and core member assembly to deform to form said small-diameter portion.

15. A method of manufacturing a center electrode for a spark plug, comprising the steps of:

preparing a bottomed cylindrical metal cup formed as a hollow cylinder with an open end, preparing a solid cylindrical core made of metal higher in the coefficient of thermal conductivity than that of the metal of the metal cup, press-fitting the core member into the metal cup to form a cup and core assembly;

setting the cup and core assembly into a die having a large diameter portion, an intermediate diameter portion and a small-diameter portion; and cold-forging the cup and core assembly in said die to cause the cup and core assembly to comprise a large-diameter portion, an intermediate-diameter portion ad a small-diameter portion corresponding to said portions of said die, wherein said small-diameter portion of said cup and core assembly is smaller in diameter than a transverse cross-section through said cup and core member, thereby forming the center electrode.

16. A method of manufacturing according to claim 15, further comprising, before said setting step and after said pressed fitting step, first setting the cup and core assembly into a first die defining a first small-diameter portion and performing a cold- forging process to form a small-diameter portion protruding axially from the closed end of the metal cup;

extruding the cup and core assembly to reduce a diameter thereof; and then setting the cup and core assembly into said die that has said large, intermediate and small-diameter portions.

* * * * *